US012330761B2

(12) United States Patent
Harada et al.

(10) Patent No.: US 12,330,761 B2
(45) Date of Patent: Jun. 17, 2025

(54) SYSTEM FOR AND METHOD OF CONTROLLING WATERCRAFT

(71) Applicant: YAMAHA HATSUDOKI KABUSHIKI KAISHA, Iwata (JP)

(72) Inventors: Hidehiko Harada, Shizuoka (JP); Jumpei Yasuda, Shizuoka (JP); Ryota Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 214 days.

(21) Appl. No.: 18/094,423

(22) Filed: Jan. 9, 2023

(65) Prior Publication Data

US 2023/0312072 A1 Oct. 5, 2023

(30) Foreign Application Priority Data

Apr. 1, 2022 (JP) ..... 2022-062136

(51) Int. Cl.
*B63H 20/12* (2006.01)
*B63H 25/42* (2006.01)
(Continued)

(52) U.S. Cl.
CPC ..... *B63H 20/12* (2013.01); *B63H 25/42* (2013.01); *B63H 2020/003* (2013.01); *B63H 2025/026* (2013.01); *B63H 2025/045* (2013.01)

(58) Field of Classification Search
CPC .. B63H 20/12; B63H 25/42; B63H 2020/003; B63H 2025/026; B63H 2025/045; B63B 79/15; B63B 79/30; B63B 79/10
See application file for complete search history.

(56) References Cited

U.S. PATENT DOCUMENTS

2018/0281907 A1* 10/2018 Hashizume ..... B63B 49/00
2020/0331578 A1 10/2020 Sakashita et al.

FOREIGN PATENT DOCUMENTS

EP 4 224 897 A1 8/2023
JP 2011-113538 A 6/2011
(Continued)

OTHER PUBLICATIONS

Official Communication issued in corresponding European Patent Application No. 22209848.5, mailed on Sep. 1, 2023.

*Primary Examiner* — Brian P Sweeney
(74) *Attorney, Agent, or Firm* — Keating & Bennett, LLP

(57) ABSTRACT

A system includes a data communication module, a position sensor, and a controller. The position sensor is operable to detect a position of a watercraft. The controller is configured or programmed to send at least one of functional information, trouble information, or operational information to an external computer through a data communication module. In the functional information, an automatic control function of a marine propulsion device and the position of the watercraft when the automatic control function is used are associated with each other. In the trouble information, a trouble in the marine propulsion device and the position of the watercraft when the trouble occurred are associated with each other. In the operational information, an operational pattern performed by a user for the marine propulsion device and the position of the watercraft when the operational pattern is performed are associated with each other.

20 Claims, 10 Drawing Sheets

(51) Int. Cl.

| | |
|---|---|
| *B63H 20/00* | (2006.01) |
| *B63H 25/02* | (2006.01) |
| *B63H 25/04* | (2006.01) |

(56) References Cited

FOREIGN PATENT DOCUMENTS

| | | | |
|---|---|---|---|
| JP | 2020-168921 | A | 10/2020 |
| WO | 2010/005392 | A1 | 1/2010 |

* cited by examiner

SYSTEM FOR AND METHOD OF CONTROLLING WATERCRAFT

CROSS REFERENCE TO RELATED APPLICATIONS

This application claims the benefit of priority to Japanese Patent Application No. 2022-062136 filed on Apr. 1, 2022. The entire contents of this application are hereby incorporated herein by reference.

BACKGROUND OF THE INVENTION

1. Field of the Invention

The present invention relates to a system for and a method of controlling a watercraft.

2. Description of the Related Art

A type of system for controlling a watercraft has an automatic control function. In the automatic control function, the system automatically controls a marine propulsion device attached to the watercraft. For example, a system for controlling a watercraft described in Japan Laid-open Patent Application Publication No. 2020-168921 has a position keeping function. In the position keeping function, the system controls a marine propulsion device such that the watercraft is kept in a predetermined position.

The aforementioned system for controlling a watercraft includes an operating member to be operated by a user. The operating member includes a shift lever, a steering wheel, and/or a joystick. The user operates the shift lever to perform switching between a forward moving action and a rearward moving action by the marine propulsion device. The user operates the steering wheel to turn the watercraft. The user operates the joystick to move the watercraft forward, rearward, rightward, and leftward.

SUMMARY OF THE INVENTION

The maritime environment is greater in diversity than the onshore environment. Because of this, it is not easy to grasp the following information at sea: in what kind of environment the automatic control function is used by the user; what kind of automatic control function is used by the user; and in what kind of operational pattern the operator is operated by the user. The information described herein makes it possible to grasp how the marine propulsion device is used by the user. Thus, the information is useful to enhance user convenience.

When a trouble occurs in the watercraft at sea, it is not easy to solve the trouble. If it is possible to grasp what kind of environment the trouble occurs in and what kind of trouble occurs by collecting information, such information collection is helpful to tackle a recurrence of the trouble. Consequently, user convenience is enhanced.

Preferred embodiments of the present invention enhance user convenience by collecting information indicating what kind of environment a marine propulsion device is used in, how the marine propulsion device is used, or what kind of trouble occurs.

A system according to a preferred embodiment of the present invention relates to a system for controlling a watercraft including a marine propulsion device. The system includes a data communication module, a position sensor, and a controller. The data communication module is operable to perform wireless communication with an external computer. The position sensor is operable to detect a position of the watercraft. The controller is configured or programmed to obtain the position of the watercraft. The controller is configured or programmed to send at least one of functional information, trouble information, or operational information to the external computer through the data communication module. In the functional information, an automatic control function of the marine propulsion device and the position of the watercraft when the automatic control function is used are associated with each other. In the trouble information, a trouble in the marine propulsion device and the position of the watercraft when the trouble occurred are associated with each other. In the operational information, an operational pattern performed by a user for the marine propulsion device and the position of the watercraft when the operational pattern is performed are associated with each other.

A method according to another preferred embodiment of the present invention relates to a method of controlling a watercraft including a marine propulsion device. The method includes obtaining a position of the watercraft, and sending at least one of functional information, trouble information, or operational information to an external computer. In the functional information, an automatic control function of the marine propulsion device and the position of the watercraft when the automatic control function is used are associated with each other. In the trouble information, a trouble in the marine propulsion device and the position of the watercraft when the trouble occurred are associated with each other. In the operational information, an operational pattern performed by a user for the marine propulsion device and the position of the watercraft when the operational pattern is performed are associated with each other.

According to a preferred embodiment of the present invention, at least one of the functional information, the trouble information, or the operational information is sent to the external computer. In the functional information, the used automatic control function and the position of the watercraft obtained at the time of use of the automatic control function are associated with each other. In the trouble information, the trouble that occurred and the position of the watercraft obtained at the time of the occurrence of the trouble are associated with each other. In the operational information, the operational pattern and the position of the watercraft obtained in the performance of the operational pattern are associated with each other. Therefore, at least one of the functional information, the trouble information, or the operational information is collected by the external computer such that user convenience is enhanced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
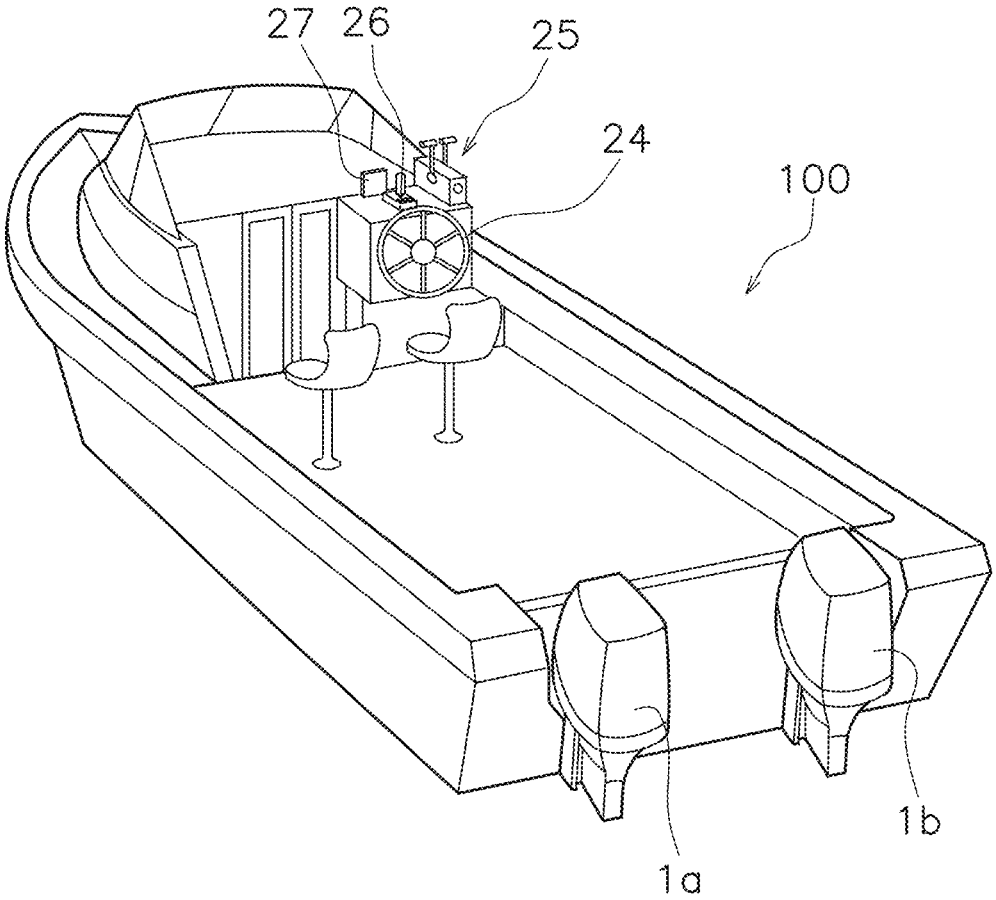
FIG. 1 is a perspective view of a watercraft according to a preferred embodiment of the present invention.

Preferred embodiments of the present invention will be hereinafter explained with reference to the drawings. FIG. 1 is a perspective view of a watercraft 100 to which marine propulsion devices 1*a* and 1*b* according to a preferred embodiment of the present invention are mounted. The marine propulsion devices 1*a* and 1*b* are mounted to the watercraft 100 as a plurality of marine propulsion devices. In the present preferred embodiment, the marine propulsion devices 1*a* and 1*b* are outboard motors. The marine propulsion devices 1*a* and 1*b* are attached to the stern of the watercraft 100. The marine propulsion devices 1*a* and 1*b* are aligned in the width direction of the watercraft 100. Specifically, the marine propulsion device 1*a* is located on the port side of the watercraft 100. The marine propulsion device 1*b* is located on the starboard side of the watercraft 100. Each marine propulsion device 1*a*, 1*b* generates a thrust to propel the watercraft 100.

Figure 2:
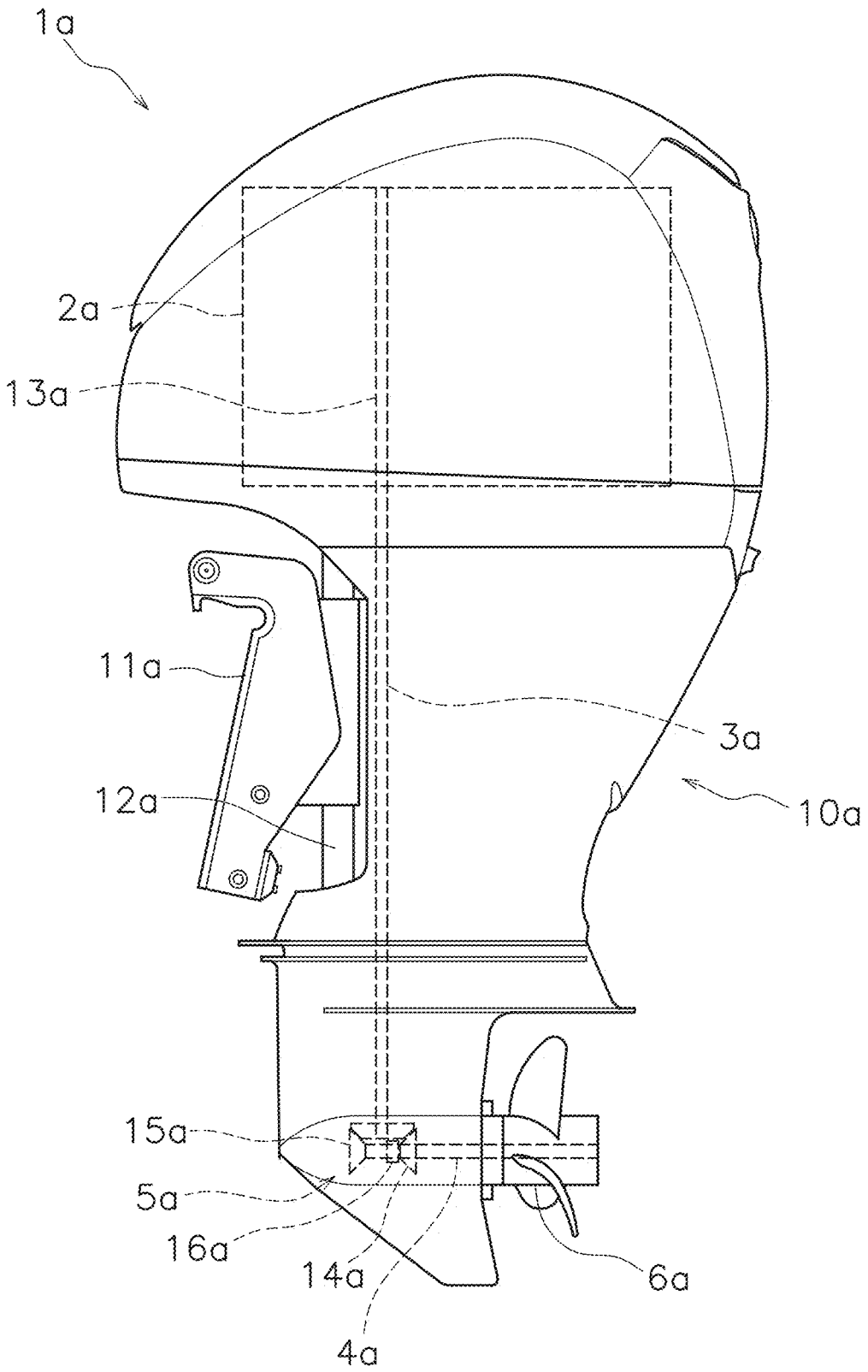
FIG. 2 is a side view of a marine propulsion device.

FIG. 2 is a side view of the marine propulsion device 1*a*. The structure of the marine propulsion device 1*a* will be hereinafter explained. However, the structure of the marine propulsion device 1*a* is also true of the marine propulsion device 1*b*. The marine propulsion device 1*a* is attached to the watercraft 100 through a bracket 11*a*. The bracket 11*a* supports the marine propulsion device 1*a* such that the marine propulsion device 1*a* is rotatable about a steering shaft 12*a*. The steering shaft 12*a* extends in the up-and-down direction of the marine propulsion device 1*a*.

The marine propulsion device 1*a* includes a drive source 2*a*, a drive shaft 3*a*, a propeller shaft 4*a*, a shift mechanism 5*a*, and a housing 10*a*. The drive source 2*a* generates the thrust to propel the watercraft 100. The drive source 2*a* is an internal combustion engine, for example. The drive source 2*a* includes a crankshaft 13*a*. The crankshaft 13*a* extends in the up-and-down direction of the marine propulsion device 1*a*.

The drive shaft 3*a* is connected to the crankshaft 13*a*. The drive shaft 3*a* extends in the up-and-down direction of the marine propulsion device 1*a*. The propeller shaft 4*a* extends in the back-and-forth direction of the marine propulsion device 1*a*. The propeller shaft 4*a* is connected to the drive shaft 3*a* through the shift mechanism 5*a*. A propeller 6*a* is attached to the propeller shaft 4*a*.

The shift mechanism 5*a* includes a forward moving gear 14*a*, a rearward moving gear 15*a*, and a dog clutch 16*a*. When gear engagement of each gear 14*a*, 15*a* is switched by the dog clutch 16*a*, the shift mechanism 5*a* is switched among a forward moving state, a rearward moving state, and a neutral state. When set in the forward moving state, the shift mechanism 5*a* transmits rotation, directed to move the watercraft 100 forward, from the drive shaft 3*a* to the propeller shaft 4*a*. When set in the rearward moving state, the shift mechanism 5*a* transmits rotation, directed to move the watercraft 100 rearward, from the drive shaft 3*a* to the propeller shaft 4*a*. When set in the neutral state, the shift mechanism 5*a* does not transmit rotation from the drive shaft 3*a* to the propeller shaft 4*a*. The housing 10*a* accommodates the drive source 2*a*, the drive shaft 3*a*, the propeller shaft 4*a*, and the shift mechanism 5*a*.

Figure 3:
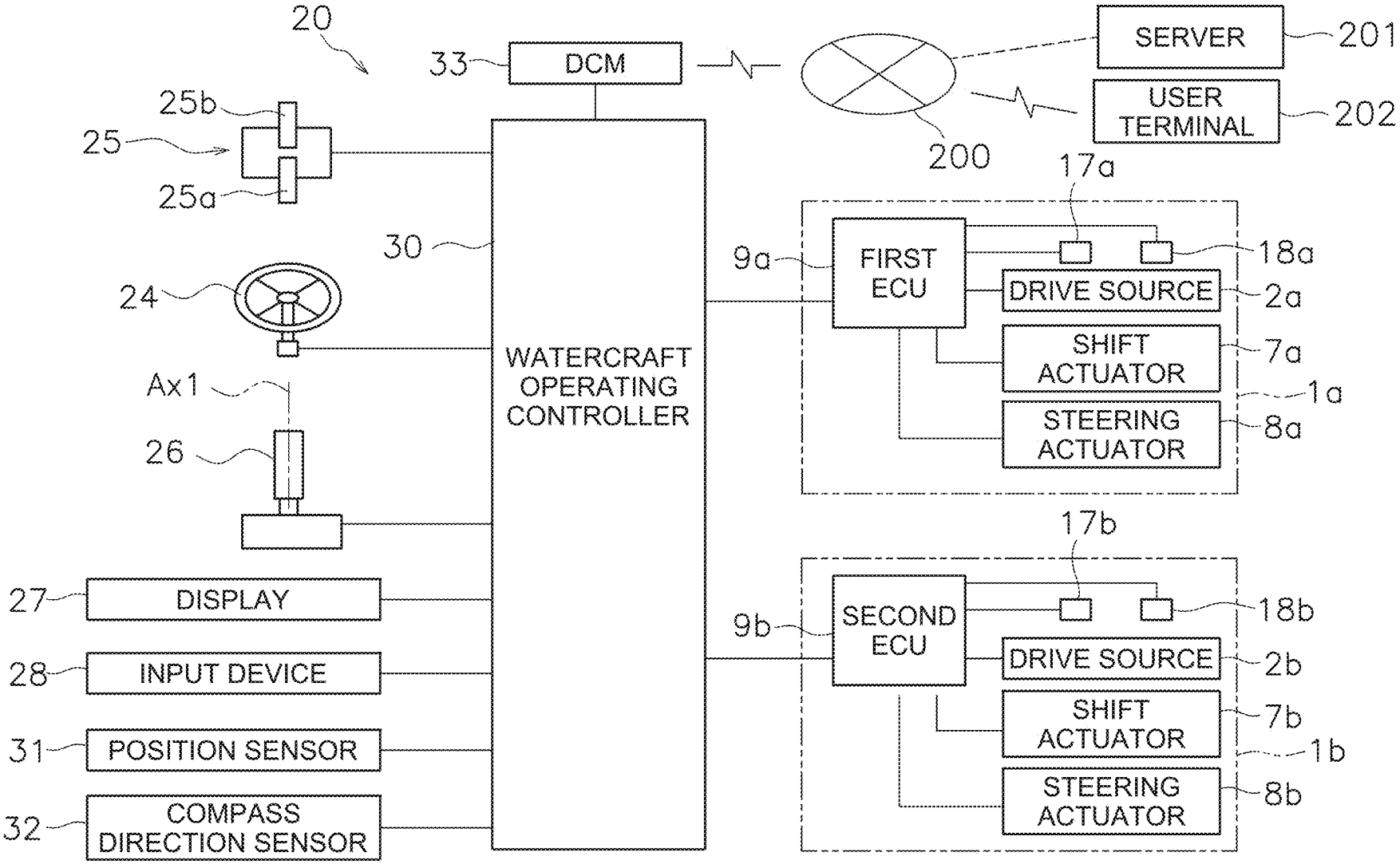
FIG. 3 is a schematic diagram showing a configuration of a system for controlling the watercraft.

FIG. 3 is a schematic diagram for showing a configuration of a control system 20 for the watercraft 100. As shown in FIG. 3, the marine propulsion device 1*a* includes a shift actuator 7*a* and a steering actuator 8*a*.

The shift actuator 7*a* is connected to the dog clutch 16*a* of the shift mechanism 5*a*. The shift actuator 7*a* actuates the dog clutch 16*a* to switch gear engagement of each gear 14*a*, 15*a*. In response, the shift mechanism 5*a* is switched among the forward moving state, the rearward moving state, and the neutral state. The shift actuator 7*a* includes, for instance, an electric motor. However, the shift actuator 7*a* may be another type of actuator such as an electric cylinder, a hydraulic motor, or a hydraulic cylinder.

The steering actuator 8*a* is connected to the marine propulsion device 1*a*. The steering actuator 8*a* rotates the marine propulsion device 1*a* about the steering shaft 12*a*. Accordingly, the marine propulsion device 1*a* is changed in rudder angle. The steering actuator 8*a* includes, for instance, an electric motor. However, the steering actuator 8*a* may be another type of actuator such as an electric cylinder, a hydraulic motor, or a hydraulic cylinder.

The marine propulsion device 1*a* includes a first ECU 9*a*. The first ECU 9*a* includes a processor such as a CPU (Central Processing Unit) and memories such as a RAM (Random Access Memory) and a ROM (Read Only Memory). The first ECU 9*a* stores programs and data to control the marine propulsion device 1*a*. The first ECU 9*a* controls the drive source 2*a*.

The marine propulsion device 1*b* includes a drive source 2*b*, a shift actuator 7*b*, a steering actuator 8*b*, and a second ECU 9*b*. The drive source 2*b*, the shift actuator 7*b*, the steering actuator 8*b*, and the second ECU 9*b* in the marine propulsion device 1*b* are configured in a similar manner to the drive source 2*a*, the shift actuator 7*a*, the steering actuator 8*a*, and the first ECU 9*a* in the marine propulsion device 1*a*, respectively.

The control system 20 includes a steering operating device 24, a throttle-shift operating device 25, and a joystick 26. The steering operating device 24, the throttle-shift operating device 25, and the joystick 26 are located in a cockpit of the watercraft 100.

The steering operating device 24 is operable by a user to adjust the rudder angle of each marine propulsion device 1*a*, 1*b*. The steering operating device 24 includes, for instance, a steering wheel. The steering operating device 24 outputs a steering signal indicating the operating position thereof.

The throttle-shift operating device 25 includes a first throttle-shift operating member 25*a* and a second throttle-shift operating member 25*b*. Each of the first and second throttle-shift operating members 25*a* and 25*b* includes, for instance, a lever. However, each of the first and second throttle-shift operating members 25*a* and 25*b* may be another member such as a switch.

The first throttle-shift operating member 25*a* is operable by the user to regulate the output rotational speed of the marine propulsion device 1*a*. The first throttle-shift operating member 25*a* is also operable by the user to perform switching between a forward moving action and a rearward moving action by the marine propulsion device 1*a*. The first throttle-shift operating member 25*a* is operable from a neutral position to a forward moving position and a rearward moving position. The throttle-shift operating device 25 outputs a throttle signal indicating the operating position of the first throttle-shift operating member 25*a*.

The second throttle-shift operating member 25*b* is operable by the user to regulate the output rotational speed of the marine propulsion device 1*b*. The second throttle-shift operating member 25*b* is also operable by the user to perform switching between a forward moving action and a rearward moving action by the marine propulsion device 1*b*. The second throttle-shift operating member 25*b* is configured in a similar manner to the first throttle-shift operating member 25*a*. The throttle-shift operating device 25 outputs a throttle signal indicating the operating position of the second throttle-shift operating member 25*b*.

The joystick 26 is operable by the user to move the watercraft 100 forward, rearward, rightward, and leftward. The joystick 26 is operable from a neutral position in front, rear, right, and left directions. The joystick 26 may be operable from the neutral position in all directions. The joystick 26 is operable by the user to cause the watercraft 100 to perform a bow turning motion. The joystick 26 is operable about a center axis Ax1 thereof by a twist operation. The joystick 26 outputs a joystick signal indicating the operating position thereof.

The control system 20 includes a watercraft operating controller 30. The watercraft operating controller 30 includes a processor such as a CPU, memories such as a RAM and a ROM, and a storage such as an HDD (Hard Disk Drive) or an SSD (Solid State Drive). The watercraft operating controller 30 stores programs and data to control the marine propulsion devices 1*a* and 1*b*. The watercraft operating controller 30 is connected to the first and second ECUs 9*a* and 9*b* through wired or wireless communication. The watercraft operating controller 30 is connected to the steering operating device 24, the throttle-shift operating device 25, and the joystick 26 through wired or wireless communication.

The watercraft operating controller 30 receives the steering signal from the steering operating device 24. The watercraft operating controller 30 receives the throttle signals from the throttle-shift operating device 25. The watercraft operating controller 30 outputs command signals to the first and second ECUs 9*a* and 9*b* based on the steering signal and the throttle signals. The command signals are sent to the shift actuator 7*a* and the steering actuator 8*a* through the first ECU 9*a*. The command signals are sent to the shift actuator 7*b* and the steering actuator 8*b* through the second ECU 9*b*.

For example, the watercraft operating controller 30 outputs the command signal to the shift actuator 7*a* in accordance with the operating position of the first throttle-shift operating member 25*a*. In response, switching between the forward moving action and the rearward moving action by the marine propulsion device 1*a* is performed. The watercraft operating controller 30 also outputs a throttle command for the drive source 2*a* in accordance with the operating position of the first throttle-shift operating member 25*a*. The first ECU 9*a* controls the output rotational speed of the marine propulsion device 1*a* in accordance with the throttle command.

The watercraft operating controller 30 outputs a command signal for the shift actuator 7*b* in accordance with the operating position of the second throttle-shift operating member 25*b*. In response, switching between the forward moving action and the rearward moving action by the marine propulsion device 1*b* is performed. The watercraft operating controller 30 also outputs a throttle command for the drive source 2*b* in accordance with the operating position of the second throttle-shift operating member 25*b*. The second ECU 9*b* controls the output rotational speed of the marine propulsion device 1*b* in accordance with the throttle command.

The watercraft operating controller 30 outputs command signals for the steering actuators 8*a* and 8*b* in accordance with the operating position of the steering operating device 24. The watercraft operating controller 30 controls the rudder angles of the marine propulsion devices 1*a* and 1*b* in accordance with the operating position of the steering operating device 24.

When the steering operating device 24 is operated leftward from a neutral position, the watercraft operating controller 30 controls the steering actuators 8*a* and 8*b* such that the marine propulsion devices 1*a* and 1*b* are rotated rightward. The watercraft 100 thus turns leftward. When the steering operating device 24 is operated rightward from the neutral position, the watercraft operating controller 30 controls the steering actuators 8*a* and 8*b* such that the marine propulsion devices 1*a* and 1*b* are rotated leftward. The watercraft 100 thus turns rightward.

The watercraft operating controller 30 outputs the command signals to each drive source 2*a*, 2*b*, each shift actuator 7*a*, 7*b*, and each steering actuator 8*a*, 8*b* in accordance with the operating position of the joystick 26. When the joystick 26 is operated in any of front, rear, right, and left directions, the watercraft operating controller 30 controls the marine propulsion devices 1*a* and 1*b* such that the watercraft 100 moves in a direction corresponding to the operating direction of the joystick 26.

Figure 4:
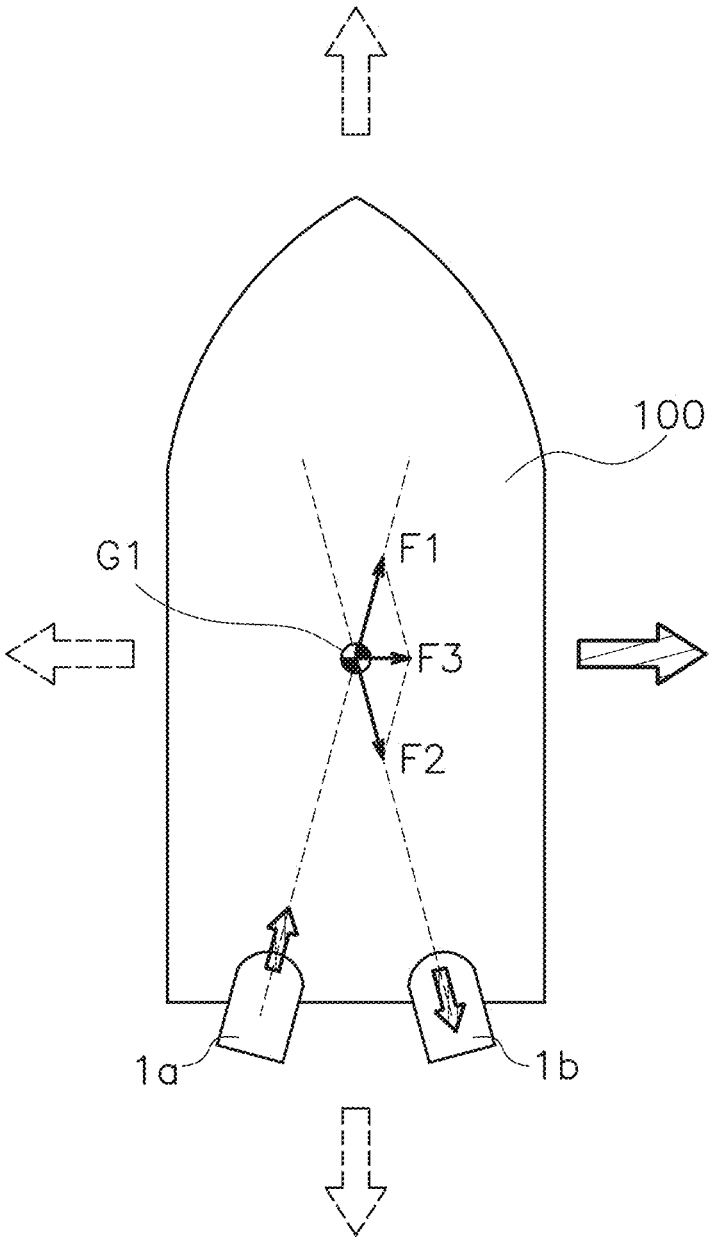
FIG. 4 is a schematic diagram showing a control executed on the marine propulsion device by a joystick.

For example, when the joystick 26 is operated rightward, as shown in FIG. 4, the watercraft operating controller 30 controls the thrust and the rudder angle of each marine propulsion device 1*a*, 1*b* such that a net thrust (F3) of the thrust (F1) of the marine propulsion device 1*a* and the thrust (F2) of the marine propulsion device 1*b* is oriented rightward while extending from the center of gravity (G1) of the watercraft 100. Accordingly, the watercraft 100 performs a rightward translational motion. Likewise, when the joystick 26 is operated leftward, the watercraft operating controller 30 controls the thrust F1, F2 and the rudder angle of each marine propulsion device 1*a*, 1*b* such that the net thrust F3 of the thrust F1 of the marine propulsion device 1*a* and the thrust F2 of the marine propulsion device 1*b* is oriented leftward while extending from the center of gravity G1 of the watercraft 100.

Figure 5:
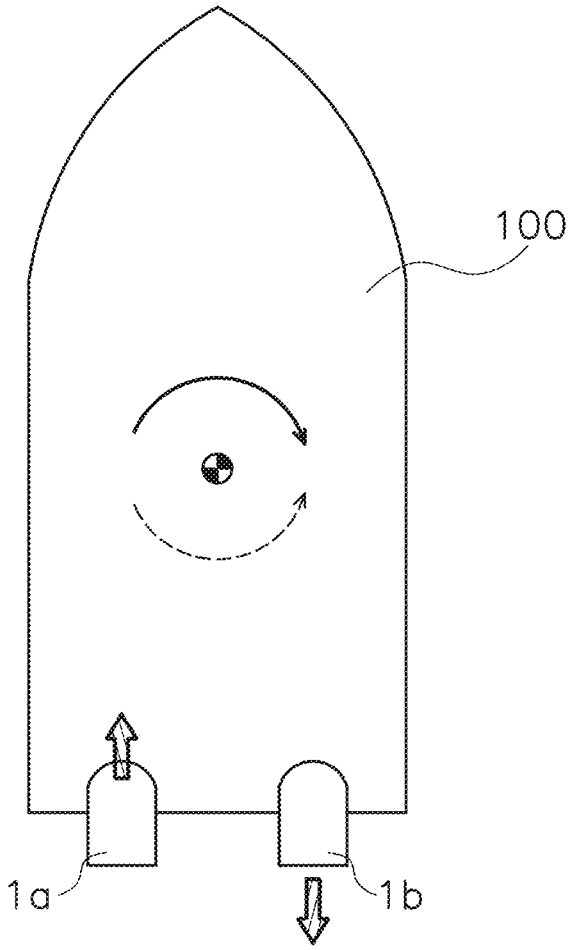
FIG. 5 is a schematic diagram showing another control executed on the marine propulsion device by the joystick.

When the joystick 26 is twisted, the watercraft operating controller 30 controls each marine propulsion device 1*a*, 1*b* such that the watercraft 100 performs a bow turning motion in a direction corresponding to the twist direction of the joystick 26. For example, when the joystick 26 is twisted clockwise, as shown in FIG. 5, the watercraft operating controller 30 causes the marine propulsion device 1*a* to generate a thrust oriented in the forward moving direction, and simultaneously, causes the marine propulsion device 1*b* to generate a thrust oriented in the rearward moving direction. Accordingly, the watercraft 100 performs a clockwise bow turning motion. Likewise, when the joystick 26 is twisted counterclockwise, the watercraft operating controller 30 causes the marine propulsion device 1*b* to generate a thrust oriented in the forward moving direction, and simultaneously, causes the marine propulsion device 1*a* to generate a thrust oriented in the rearward moving direction. Accordingly, the watercraft 100 performs a counterclockwise bow turning motion.

As shown in FIG. 3, the control system 20 includes a display 27 and an input device 28. The display 27 displays information regarding each marine propulsion device 1*a*, 1*b*. The display 27 displays an image in response to an image signal inputted thereto.

The input device 28 receives an operational input by the user. The input device 28 outputs an input signal indicating the operational input by the user. The input device 28 may be located in the joystick 26. Alternatively, the input device 28 may be located at a position separated from the joystick 26. The input device 28 includes at least one switch. The input device 28 may not necessarily include the at least one switch, and alternatively, may include another type of device such as a touchscreen.

The marine propulsion device 1*a* includes a rotational speed sensor 17*a* and a temperature sensor 18*a*. The rotational speed sensor 17*a* outputs a rotational speed signal indicating the output rotational speed of the drive source 2*a*. The temperature sensor 18*a* outputs a temperature signal indicating the temperature of the drive source 2*a*. The watercraft operating controller 30 receives the rotational speed signal from the rotational speed sensor 17*a*. The watercraft operating controller 30 receives the temperature signal from the temperature sensor 18*a*.

The marine propulsion device 1*b* includes a rotational speed sensor 17*b* and a temperature sensor 18*b*. The rotational speed sensor 17*b* outputs a rotational speed signal indicating the output rotational speed of the drive source 2*b*. The temperature sensor 18*b* outputs a temperature signal indicating the temperature of the drive source 2*b*. The watercraft operating controller 30 receives the rotational speed signal from the rotational speed sensor 17*b*. The watercraft operating controller 30 receives the temperature signal from the temperature sensor 18*b*.

The watercraft operating controller 30 determines whether or not over-revolution of the drive source 2*a* is occurring based on the output rotational speed of the drive source 2*a*. For example, when the output rotational speed of the drive source 2*a* is greater than or equal to a predetermined threshold of rotational speed, the watercraft operating controller 30 determines that over-revolution of the drive source 2*a* is occurring. When it is determined that over-revolution of the drive source 2*a* is occurring, the watercraft operating controller 30 causes the display 27 to display an alert. Alternatively, when it is determined that over-revolution of the drive source 2*a* is occurring, the watercraft operating controller 30 may turn on a warning lamp. Likewise, the watercraft operating controller 30 determines whether or not over-revolution of the drive source 2*b* is occurring based on the output rotational speed of the drive source 2*b*.

The watercraft operating controller 30 determines whether or not overheating of the drive source 2*a* is occurring based on the temperature of the drive source 2*a*. For example, when the temperature of the drive source 2*a* is greater than or equal to a predetermined threshold of temperature, the watercraft operating controller 30 determines that overheating of the drive source 2*a* is occurring. When it is determined that overheating of the drive source 2*a* is occurring, the watercraft operating controller 30 causes the display 27 to display an alert. Alternatively, when it is determined that overheating of the drive source 2*a* is occurring, the watercraft operating controller 30 may turn on a warning lamp. Likewise, the watercraft operating controller 30 determines whether or not overheating of the drive source 2*b* is occurring based on the temperature of the drive source 2*b*.

The control system 20 includes a position sensor 31. The position sensor 31 detects the position of the watercraft 100. The position sensor 31 includes a GNSS (Global Navigation Satellite System) receiver such as a GPS (Global Positioning System) receiver. However, the position sensor 31 may be a type of sensor other than the GNSS receiver. The position sensor 31 outputs a position signal indicating the position of the watercraft 100. The watercraft operating controller 30 is connected to the position sensor 31 in a communicable manner. The watercraft operating controller 30 obtains the position of the watercraft 100 based on the position signal transmitted thereto from the position sensor 31. The watercraft operating controller 30 also obtains the velocity of the watercraft 100 based on the position signal transmitted thereto from the position sensor 31. The control system 20 may include another type of sensor to detect the velocity of the watercraft 100.

The system includes a compass direction sensor 32. The compass direction sensor 32 detects a compass direction of the bow of the watercraft 100. The compass direction sensor 32 includes, for instance, an IMU (Inertial Measurement Unit). However, the compass direction sensor 32 may be a type of sensor other than the IMU. The compass direction sensor 32 outputs a compass direction signal indicating the compass direction of the bow of the watercraft 100. The watercraft operating controller 30 is connected to the compass direction sensor 32 in a communicable manner. The watercraft operating controller 30 obtains the compass direction of the watercraft 100 based on the compass direction signal transmitted thereto from the compass direction sensor 32.

The watercraft operating controller 30 provides automatic control functions of the watercraft 100. The watercraft operating controller 30 automatically controls the watercraft 100 with the automatic control functions based on the position and the compass direction of the watercraft 100. The input device 28 is operable by the user to select one of the automatic control functions. The input device 28 outputs an input signal indicating which one of the automatic control functions has been selected by the user. The watercraft operating controller 30 receives the input signal from the input device 28. The watercraft operating controller 30 automatically controls the watercraft 100 in accordance with the selected one of the automatic control functions.

The automatic control functions include an autopilot function and a position keeping function. Under the autopilot function, the watercraft operating controller 30 controls each marine propulsion device 1*a*, 1*b* such that the watercraft 100 moves in a predetermined trajectory. Under the position keeping function, the watercraft operating controller 30 controls each marine propulsion device 1*a*, 1*b* such that the watercraft 100 is kept located in a predetermined position.

Figure 6:
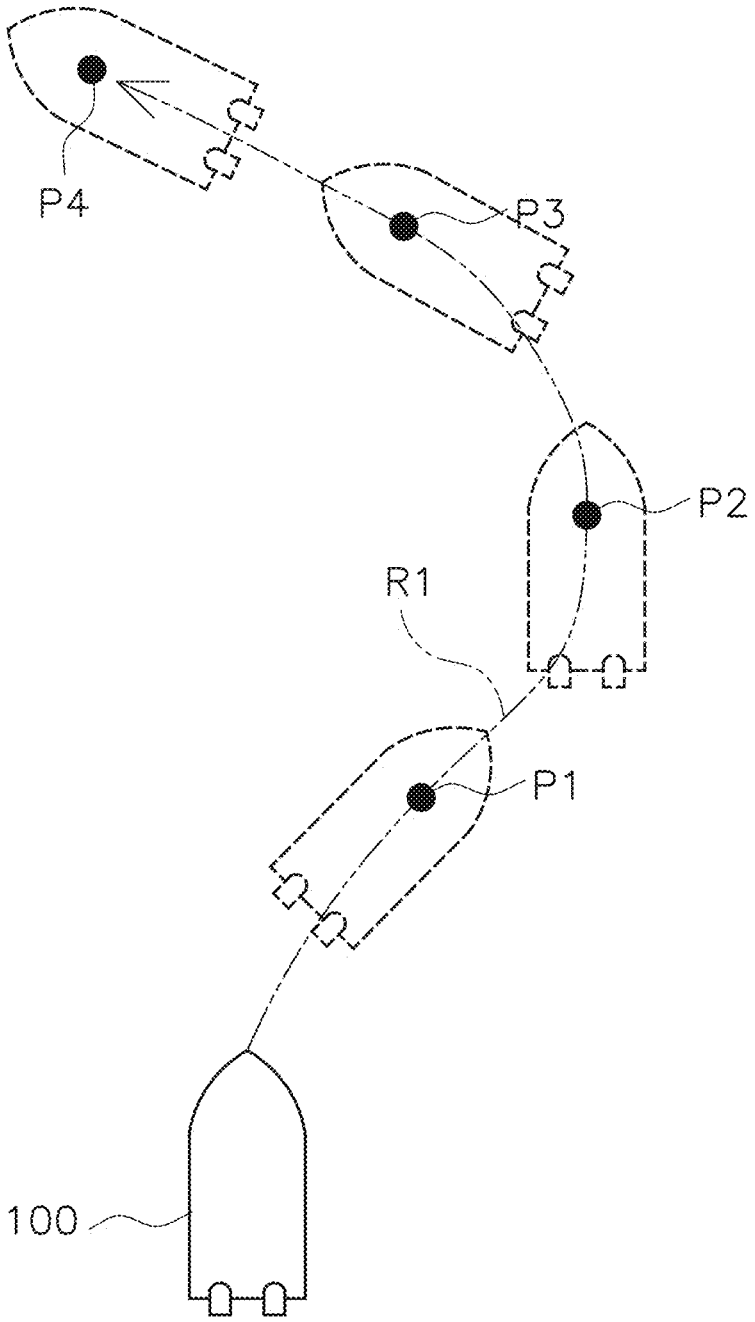
FIG. 6 is a diagram showing motions of the watercraft in an autopilot function.

As shown in FIG. 6, under the autopilot function, the watercraft operating controller 30 controls each marine propulsion device 1*a*, 1*b* such that the watercraft 100 moves along a route R1 to be set. The user sets the route R1 with the input device 28. More specifically, the user specifies a plurality of target spots P1 to P4, including the target spot P4 as a destination, with the input device 28. For example, the user arbitrarily selects the target spots P1 to P4 on a map displayed on the display 27. The input device 28 outputs an operating signal indicating the plurality of target spots P1 to P4 selected by the user. The number of target spots may be one. The watercraft operating controller 30 computes the route R1 on which the target spots P1 to P4 are located. The watercraft operating controller 30 controls the thrust and the rudder angle of each marine propulsion device 1*a*, 1*b* such that the watercraft 100 moves along the route R1.

Figure 7:
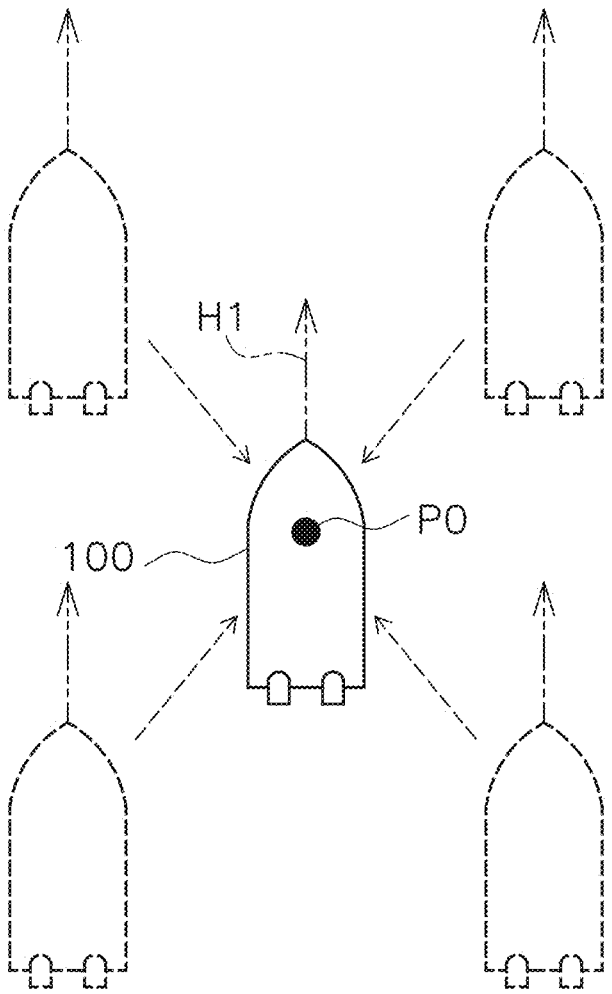
FIG. 7 is a diagram showing motions of the watercraft in a position keeping function.

As shown in FIG. 7, under the position keeping function, the watercraft operating controller 30 keeps the watercraft 100 located in a setting position P0, while the bow of the watercraft 100 is kept oriented in a target direction H1. For example, the watercraft operating controller 30 determines, as the target direction H1, a direction in which the watercraft 100 is oriented when selecting the position keeping function with the input device 28. The watercraft operating controller 30 determines, as the setting position P0, a position in which the watercraft 100 is located when selecting the position keeping function with the input device 28. The watercraft operating controller 30 controls the thrust and the rudder angle of each marine propulsion device 1*a*, 1*b* such that the watercraft 100 is kept located in the setting position P0, while the bow thereof is kept oriented in the target direction H1.

The control system 20 includes a data communication module (hereinafter referred to as "DCM") 33. The DCM 33 performs wireless communication with an external computer. For example, the DCM 33 is able to perform data transmission with the external computer through a mobile communication network 200. The mobile communication network 200 is, for instance, a network of a 3G, 4G, or 5G mobile communication system. The DCM 33 is communicable with a server 201. The DCM 33 is communicable with a user terminal 202. The user terminal 202 may be, for instance, a smartphone, a tablet, or a personal computer. The DCM 33 may be communicable with the user terminal 202 through the server 201.

Figure 8:
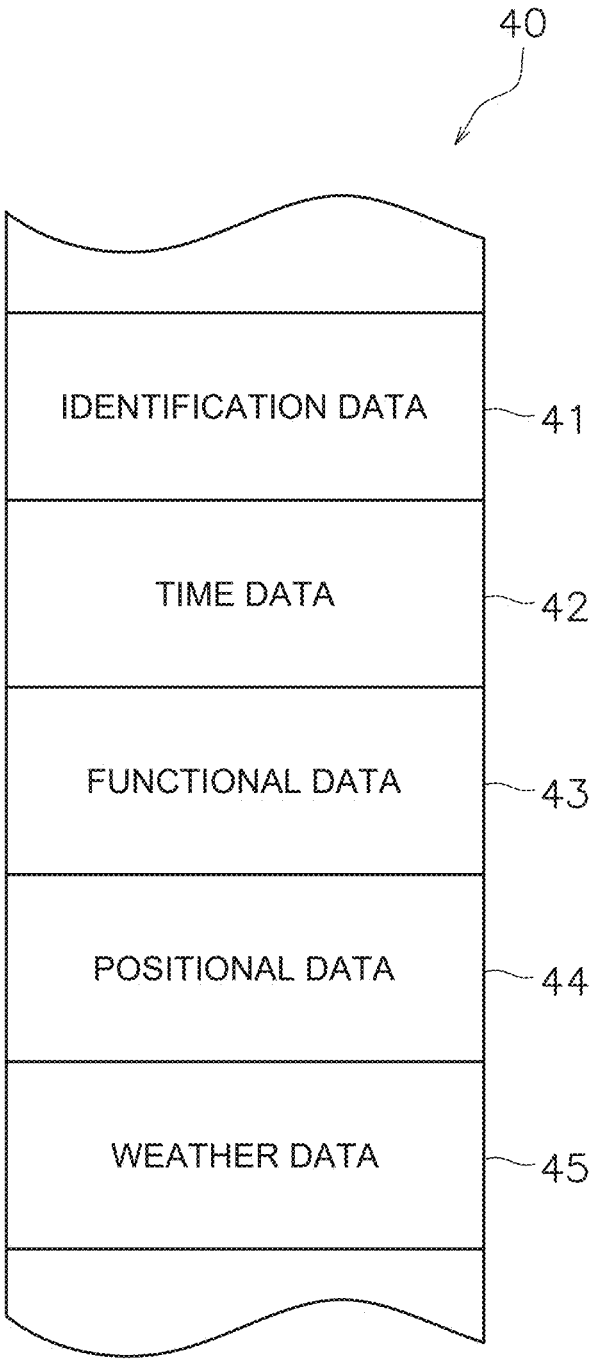
FIG. 8 is a schematic diagram showing a data structure of functional information.

The watercraft operating controller 30 sends functional information, trouble information, and operational information to the server 201 through the DCM 33. In the functional information, which one of the automatic control functions is used and the position of the watercraft 100 located at the time of use of the used automatic control function are associated with each other. FIG. 8 is a schematic diagram showing a data structure of functional information 40. As shown in FIG. 8, the functional information 40 contains identification data 41, time data 42, functional data 43, positional data 44, and weather data 45.

The identification data 41 indicates an identifier of the watercraft 100. For example, the identification data 41 may be an identification number of the watercraft 100. Alternatively, the identification data 41 may indicate an identifier specifying the type of the watercraft 100. The time data 42 indicates a set of date and clock time when the automatic control function was used. The functional data 43 indicates the automatic control function used in the watercraft 100. The positional data 44 indicates the position of the watercraft 100 when the automatic control function was used. The positional data 44 may include, for instance, a set of latitude and longitude coordinates indicating the position of the watercraft 100. The weather data 45 indicates weather in the surroundings of the watercraft 100 when the automatic control function was used. The weather data 45 contains, for instance, a short-term atmospheric condition, an atmospheric pressure, a precipitation, a temperature, and a speed and a direction of wind. For example, the short-term atmospheric condition is indicated by such expressions as sunny, cloudy, rainy, and foggy.

For example, in the use of the autopilot function, the watercraft operating controller 30 generates the functional information 40 by combining the following with each other: the identification data 41; the time data 42 indicating a set of date and clock time at a time of use of the autopilot function; the functional data 43 indicating the autopilot function; the positional data 44 indicating the position of the watercraft 100 at the time of use of the autopilot function; and the weather data 45 indicating weather at the time of use of the autopilot function.

In the use of the position keeping function, the watercraft operating controller 30 generates the functional information 40 by combining the following with each other: the identification data 41; the time data 42 indicating a set of date and clock time at the time of use of the position keeping function; the functional data 43 indicating the position keeping function; the positional data 44 indicating the position of the watercraft 100 at the time of use of the position keeping function; and the weather data 45 indicating weather at the time of use of the position keeping function.

Then, the watercraft operating controller 30 sends the generated functional information 40 to the server 201 through the DCM 33. The watercraft operating controller 30 may accumulate and store a plurality of pieces of functional information 40 and may send the stored pieces of functional information 40 to the server 201 at predetermined intervals of time. The watercraft operating controller 30 may send the stored pieces of functional information 40 to the server 201 in response to a request from the server 201 or the user terminal 202. The watercraft operating controller 30 may send a piece of functional information 40 to the server 201 every time the piece of functional information 40 is generated.

Figure 9:
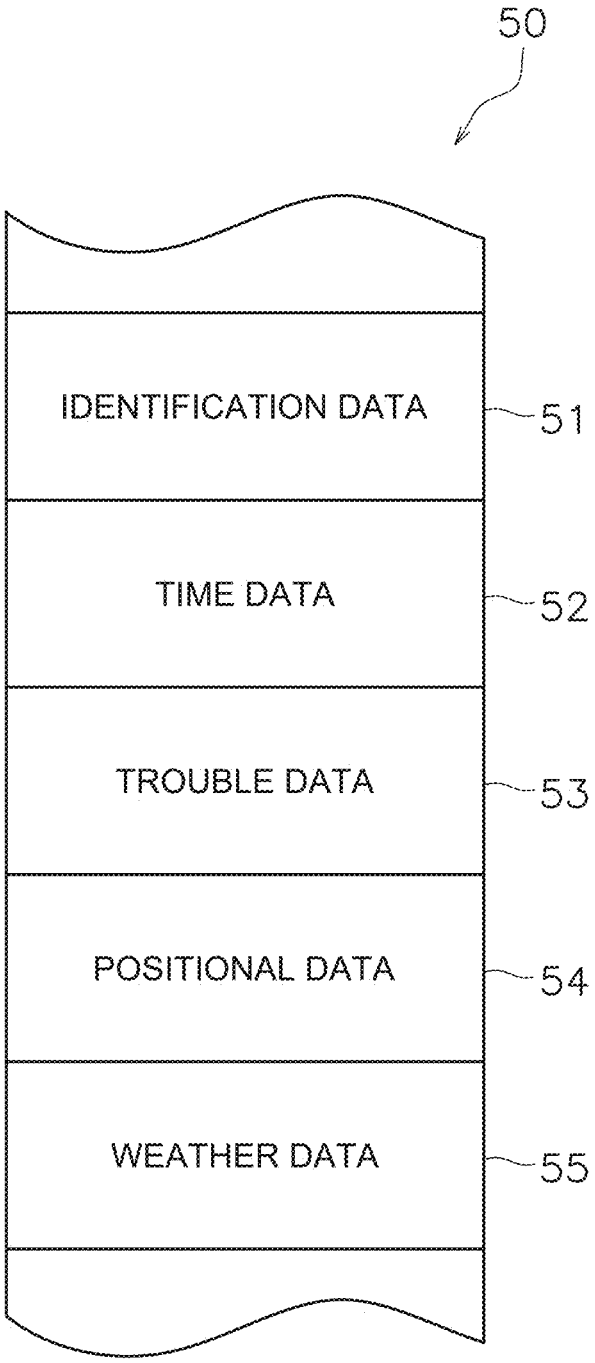
FIG. 9 is a schematic diagram showing a data structure of trouble data.

In the trouble information, a trouble that occurred in each marine propulsion device 1*a*, 1*b* and a position of the watercraft 100 at the time of an occurrence of the trouble are associated with each other. FIG. 9 is a schematic diagram showing a data structure of trouble information 50. As shown in FIG. 9, the trouble information 50 contains identification data 51, time data 52, trouble data 53, positional data 54, and weather data 55.

The identification data 51 is similar to the identification data 41 contained in the functional information 40. The time data 52 indicate a set of date and clock time at the time of an occurrence of the trouble. The trouble data 53 indicates the trouble that occurred in each marine propulsion device 1*a*, 1*b*. The positional data 54 indicates the position of the watercraft 100 at the time of occurrence of the trouble. The weather data 55 indicates the weather in the surroundings of the watercraft 100 at the time of occurrence of the trouble.

For example, in an occurrence of overheating of the drive source 2*a*, the watercraft operating controller 30 generates the trouble information 50 by combining the following with each other: the identification data 51; the time data 52 indicating a set of date and clock time at the time of the occurrence of the overheating; the trouble data 53 indicating the overheating; the positional data 54 indicating the position of the watercraft 100 at the time of the occurrence of the overheating; and the weather data 55 indicating the weather at the time of the occurrence of the overheating.

In an occurrence of over-revolution of the drive source 2*a*, the watercraft operating controller 30 generates the trouble information 50 by combining the following with each other: the identification data 51; the time data 52 indicating a set of date and clock time at the time of the occurrence of the over-revolution; the trouble data 53 indicating the over-revolution; the positional data 54 indicating the position of the watercraft 100 at the time of the occurrence of the over-revolution; and the weather data 55 indicating the weather at the time of the occurrence of the over-revolution.

Then, the watercraft operating controller 30 sends the generated trouble information 50 to the server 201 through the DCM 33. The watercraft operating controller 30 may accumulate and store a plurality of pieces of trouble information 50 and may send the stored pieces of trouble information 50 to the server 201 at predetermined intervals of time. The watercraft operating controller 30 may send the stored pieces of trouble information 50 to the server 201 in response to a request from the server 201 or the user terminal 202. The watercraft operating controller 30 may send a piece of trouble information 50 to the server 201 every time the piece of trouble information 50 is generated.

Figure 10:
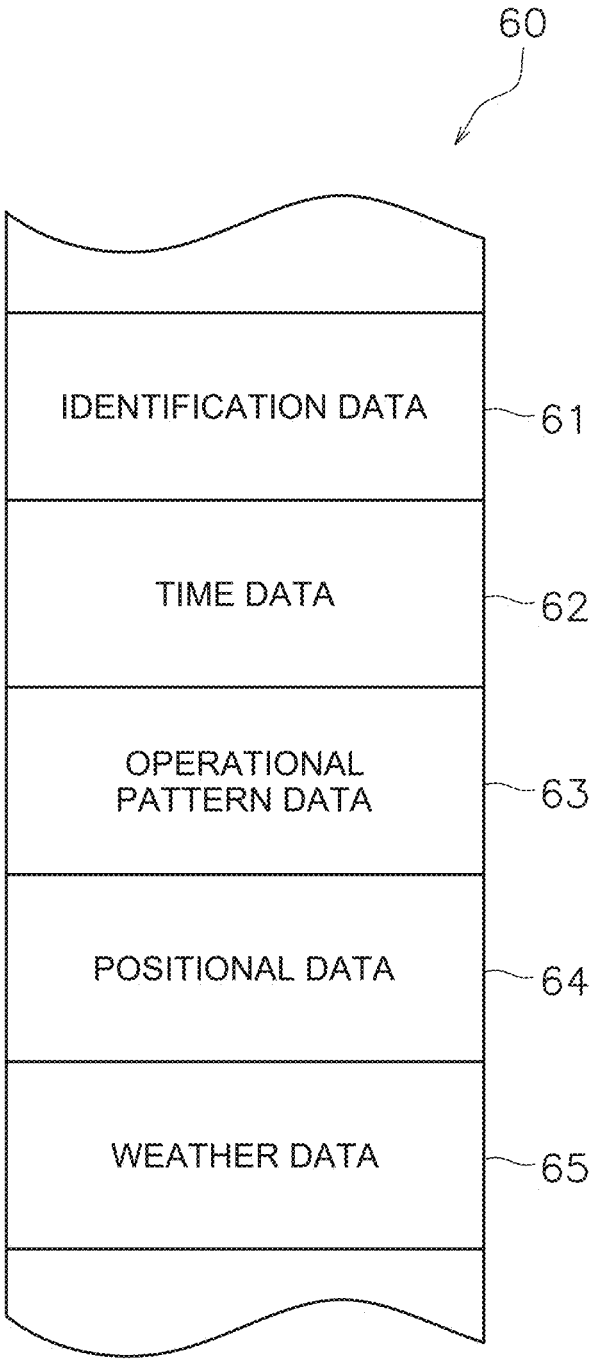
FIG. 10 is a schematic diagram showing a data structure of operational information.

In the operational information, an operational pattern performed by the user for each marine propulsion device 1*a*, 1*b* and the position of the watercraft 100 at the time of performing the operational pattern are associated with each other. FIG. 10 is a schematic diagram showing a data structure of operational information 60. As shown in FIG. 9, the operational information 60 contains identification data 61, time data 62, operational pattern data 63, positional data 64, and weather data 65.

The identification data 61 is similar to the identification data 41 contained in the functional information 40. The time data 62 indicates a set of date and clock time in an operation performed by the user for each marine propulsion device 1*a*, 1*b*. The operational pattern data 63 indicates the operation performed by the user for each marine propulsion device 1*a*, 1*b*. The operation performed by the user for each marine propulsion device 1*a*, 1*b* indicates the content of the operation performed for the steering operating device 24, that of the operation performed for the throttle-shift operating device 25, that of the operation performed for the joystick 26, and combinations of these contents. The positional data 64 indicates the position of the watercraft 100 in the operation performed by the user for each marine propulsion device 1*a*, 1*b*. The weather data 65 indicates the weather in the surroundings of the watercraft 100 in the operation performed by the user for each marine propulsion device 1*a*, 1*b*.

For example, in an operation performed by the user for the throttle-shift operating members 25*a* and 25*b*, the watercraft operating controller 30 generates the operational information 60 by combining the following with each other: the identification data 61; the time data 62 indicating a set of date and clock time at the time of the operation performed for the throttle-shift operating members 25*a* and 25*b*; the operational pattern data 63 indicating the operation performed for the throttle-shift operating members 25*a* and 25*b*; the positional data 64 indicating the position of the watercraft 100 at the time of the operation performed for the throttle-shift operating members 25*a* and 25*b*; and the weather data 65 indicating the weather at the time of the operation performed for the throttle-shift operating members 25*a* and 25*b*.

In an operation performed by the user for the steering operating device 24, the watercraft operating controller 30 generates the operational information 60 by combining the following with each other: the identification data 61; the time data 62 indicating a set of date and clock time at the time of the operation performed for the steering operating device 24; the operational pattern data 63 indicating the operation performed for the steering operating device 24; the positional data 64 indicating the position of the watercraft 100 at the time of the operation performed for the steering operating device 24; and the weather data 65 indicating the weather at the time of the operation performed for the steering operating device 24.

In an operation performed by the user for the joystick 26, the watercraft operating controller 30 generates the operational information 60 by combining the following with each other: the identification data 61; the time data 62 indicating a set of date and clock time at the time of the operation performed for the joystick 26; the operational pattern data 63 indicating the operation performed for the joystick 26; the positional data 64 indicating the position of the watercraft 100 at the time of the operation performed for the joystick 26; and the weather data 65 indicating the weather at the time of the operation performed for the joystick 26.

Then, the watercraft operating controller 30 sends the generated operational information 60 to the server 201 through the DCM 33. The watercraft operating controller 30 may accumulate and store a plurality of pieces of operational information 60 and may send the stored pieces of operational information 60 to the server 201 at predetermined intervals of time. The watercraft operating controller 30 may send the stored pieces of operational information 60 to the server 201 in response to a request from the server 201 or the user terminal 202. The watercraft operating controller 30 may send a piece of operational information 60 to the server 201 every time the piece of operational information 60 is generated.

The server 201 receives the functional information 40 from the watercraft operating controller 30. The server 201 records the received functional information 40 in a database for the functional information 40 and accumulates and stores therein the recorded functional information 40. The server 201 receives the trouble information 50 from the watercraft operating controller 30. The server 201 records the received trouble information 50 in a database for the trouble information 50 and accumulates and stores therein the recorded trouble information 50. The server 201 receives the operational information 60 from the watercraft operating controller 30. The server 201 records the received operational information 60 in a database for the operational information 60 and accumulates and stores therein the recorded operational information 60.

In the control system 20 according to a preferred embodiment of the present invention, the functional information 40, the trouble information 50, and the operational information 60 are sent to the server 201. In the functional information 40, the automatic control function and the position of the watercraft 100 at the time of use of the automatic control function are associated with each other. In the trouble information 50, the occurred trouble and the position of the watercraft 100 at the time of the occurrence of the occurred trouble are associated with each other. In the operational information 60, the performed operational pattern and the position of the watercraft 100 when performing the performed operational pattern are associated with each other. Therefore, the functional information 40, the trouble information 50, and the operational information 60 are collected by the server 201 such that user convenience is enhanced.

For example, the server 201 may specify a region in which a specific trouble occurs frequently by analyzing pieces of trouble information 50 transmitted thereto from a variety of watercraft 100. The server 201 may display a map indicating the specified region on a website on the Internet, an application installed in the user terminal 202, or the display 27. Alternatively, the server 201 may send an alert to the watercraft 100 that passes through the specified region.

The server 201 may suggest a specific watercraft 100 and a method of appropriately operating the specific watercraft 100 by analyzing the operational information 60 of the specific watercraft 100. For example, when the user manually operates the watercraft 100 such that the watercraft 100 is kept in a fixed spot, the server 201 may suggest to the user to use the position keeping function. The server 201 may suggest an appropriate method of operating the watercraft 100 in the form of a display on the display 27 or the application installed in the user terminal 202 or in the form of sending an e-mail.

Preferred embodiments of the present invention have been explained above. However, the present invention is not limited to the preferred embodiments described above, and a variety of changes can be made without departing from the gist of the present invention.

Each marine propulsion device 1*a*, 1*b* is not limited to the outboard motor, and alternatively, may be another type of propulsion device such as an inboard engine outboard drive or a jet propulsion device. The structure of each marine propulsion device 1*a*, 1*b* is not limited to that in the preferred embodiments described above and may be changed. For example, each drive source 2*a*, 2*b* may be an electric motor. The number of marine propulsion devices is not limited to two. The number of marine propulsion devices may be one or may be more than two.

The watercraft operating controller 30 may generate some of the functional information 40, the trouble information 50, and the operational information 60 and may send the generated information to the server 201. The functional information 40, the trouble information 50, and the operational information 60 are not limited to those in the preferred embodiments described above and may be changed. For example, the identification data, the time data, or the weather data may be omitted. The automatic control functions are not limited to that in the preferred embodiments described above and may be changed. For example, the automatic control functions may include a pattern control function to move the watercraft 100 along a specific trajectory having a zigzag shape, a spiral shape, or so forth.

The trouble information 50 is not limited to that in the preferred embodiments described above and may be changed. For example, the trouble information 50 may include another trouble such as an occurrence of engine stall or a jump of the watercraft 100. The operational information 60 is not limited to that in the preferred embodiments described above and may be changed. For example, the operation of the steering operating device 24 may be omitted. The operation of the throttle-shift operating device 25 may be omitted. The operation of the joystick 26 may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft including a marine propulsion device, the system comprising:

a data communication module to perform wireless communication with an external computer;

a position sensor to detect a position of the watercraft; and a controller configured or programmed to:

obtain the position of the watercraft; and send at least one of functional information, trouble information, or operational information to the external computer through the data communication module; wherein an automatic control function of the marine propulsion device and the position of the watercraft when the automatic control function is used are associated with each other in the functional information;

a trouble in the watercraft and the position of the watercraft when the trouble occurred are associated with each other in the trouble information, the trouble including at least one of overheating of a drive source of the marine propulsion device, over-revolution of the drive source, stall of the drive source, or a jump of the watercraft;

an operational pattern performed by a user for the marine propulsion device and the position of the watercraft when the operational pattern is performed are associated with each other in the operational information, the operational pattern including at least one of an operation of a shift operator to perform switching between a forward moving action and a rearward moving action by the marine propulsion device, an operation performed to steer the watercraft, or an operation performed on a joystick operable to move the watercraft forward, rearward, rightward, and leftward; and the external computer is configured or programmed to:

(1) when the trouble occurs, display a map indicating a specified region where the trouble occurs, display an application installed in a user terminal or a display, or send an alert to a watercraft that passes through the specified region; or (2) based on the operational information, suggest to the user to use a position keeping function such that the watercraft is kept in a predetermined position, suggest an appropriate method of operating the watercraft on the display or the application installed in the user terminal, or send an e-mail.

2. The system according to claim 1, wherein the functional information further includes weather data when the automatic control function is used.

3. The system according to claim 1, wherein the automatic control function includes an autopilot function to control the marine propulsion device to move the watercraft along a predetermined trajectory; and the controller is configured or programmed to:

generate the functional information by associating functional data and positional data with each other, the functional data indicating that the automatic control function used is the autopilot function, and the position data indicating the position of the watercraft when the autopilot function is used; and send the functional information to the external computer through the data communication module.

4. The system according to claim 1, wherein the automatic control function includes the position keeping function to control the marine propulsion device to keep the watercraft in the predetermined position; and the controller is configured or programmed to:

generate the functional information by associating functional data and positional data with each other, the functional data indicating that the automatic control function used is the position keeping function, and the positional data indicating the position of the watercraft when the position keeping function is used; and send the functional information to the external computer through the data communication module.

5. The system according to claim 1, wherein the trouble information further includes weather data when the trouble occurred.

6. The system according to claim 1, wherein the controller is configured or programmed to:

generate the trouble information by associating trouble data and positional data with each other, the trouble data indicating that the trouble is the overheating of the drive source, and the positional data indicating the position of the watercraft when the overheating occurred; and send the trouble information to the external computer through the data communication module.

7. The system according to claim 1, wherein the controller is configured or programmed to:

generate the trouble information by associating trouble data and positional data with each other, the trouble data indicating that the trouble occurred is the over-revolution of the drive source, and the positional data indicating the position of the watercraft when the over-revolution occurred; and send the trouble information to the external computer through the data communication module.

8. The system according to claim 1, wherein the operational information further includes weather data when the operational pattern is performed.

9. The system according to claim 1, wherein the controller is configured or programmed to:

generate the operational information by associating operational pattern data and positional data with each other, the operational pattern data indicating the operation of the shift operator, and the positional data indicating the position of the watercraft when the shift operator is operated; and send the operational information to the external computer through the data communication module.

10. The system according to claim 1, wherein the controller is configured or programmed to:

generate the operational information by associating operational pattern data and positional data with each other, the operational pattern data indicating the operation of the joystick, and the positional data indicating the position of the watercraft when the joystick is operated; and send the operational information to the external computer through the data communication module.

11. A method of controlling a watercraft including a marine propulsion device, the method comprising:

obtaining a position of the watercraft; and sending at least one of functional information, trouble information, or operational information to an external computer; wherein an automatic control function of the marine propulsion device and the position of the watercraft when the automatic control function is used are associated with each other in the functional information;

a trouble in the watercraft and the position of the watercraft obtained at a time of occurrence of the trouble are associated with each other in the trouble information, the trouble including at least one of overheating of a drive source of the marine propulsion device, over-revolution of the drive source, stall of the drive source, or a jump of the watercraft;

an operational pattern performed by a user for the marine propulsion device and the position of the watercraft when the operational pattern is performed are associated with each other in the operational information, the operational pattern including at least one of an operation of a shift operator to perform switching between a forward moving action and a rearward moving action by the marine propulsion device, an operation performed to steer the watercraft, or an operation performed on a joystick operable to move the watercraft forward, rearward, rightward, and leftward; and (1) when the trouble occurs, displaying a map indicating a specified region where the trouble occurs, displaying an application installed in a user terminal or a display, or sending an alert to a watercraft that passes through the specified region; or (2) based on the operational information, suggesting to the user to use a position keeping function such that the watercraft is kept in a predetermined position, suggesting an appropriate method of operating the watercraft on the display or the application installed in the user terminal, or sending an e-mail.

12. The method according to claim 11, wherein the functional information further includes weather data when the automatic control function is used.

13. The method according to claim 11, wherein the automatic control function includes an autopilot function to control the marine propulsion device to move the watercraft along a predetermined trajectory, the method further comprising:

generating the functional information by associating functional data and positional data with each other, the functional data indicating that the automatic control function used is the autopilot function, and the positional data indicating the position of the watercraft when the autopilot function is used; and sending the functional information to the external computer.

14. The method according to claim 11, wherein the automatic control function includes the position keeping function to control the marine propulsion device to keep the watercraft in the predetermined position, the method further comprising:

generating the functional information by associating functional data and positional data with each other, the functional data indicating that the automatic control function used is the position keeping function, and the positional data indicating the position of the watercraft when the position keeping function is used; and sending the functional information to the external computer.

15. The method according to claim 11, wherein the trouble information further includes weather data when the trouble occurred.

16. The method according to claim 11, further comprising:

generating the trouble information by associating trouble data and positional data with each other, the trouble data indicating that the trouble is the overheating of the drive source, and the positional data indicating the position of the watercraft when the overheating occurred; and sending the trouble information to the external computer.

17. The method according to claim 11, further comprising:

generating the trouble information by associating trouble data and positional data with each other, the trouble data indicating that the trouble occurred is the over-revolution of the drive source, and the positional data indicating the position of the watercraft when the over-revolution occurred; and sending the trouble information to the external computer.

18. The method according to claim 11, wherein the operational information further includes weather data when the operational pattern is performed.

19. The method according to claim 11, further comprising:

generating the operational information by associating operational pattern data and positional data with each other, the operational pattern data indicating the operation of the shift operator, and the positional data indicating the position of the watercraft when the shift operator is operated; and sending the operational information to the external computer.

20. The method according to claim 11, further comprising:

generating the operational information by associating operational pattern data and positional data with each other, the operational pattern data indicating the operation of the joystick, and the positional data indicating the position of the watercraft when the joystick is operated; and sending the operational information to the external computer.

* * * * *